US009518588B2

(12) United States Patent
Brenne et al.

(10) Patent No.: US 9,518,588 B2
(45) Date of Patent: Dec. 13, 2016

(54) SUBSEA COMPRESSOR CLEANING METHOD WHEREIN THE CLEANING LIQUID IS RETRIEVED FROM THE MULTIPHASE PROCESS FLUID

(75) Inventors: Lars Brenne, Sandnes (NO); Tor Bjørge, Hundhamaren (NO); Harald Underbakke, Sandnes (NO); Svend Tarald Kibsgaard, Porsgrunn (NO)

(73) Assignee: Statoil Petroleum AS, Stavanger (NO)

( * ) Notice: Subject to any disclaimer, the term of this patent is extended or adjusted under 35 U.S.C. 154(b) by 58 days.

(21) Appl. No.: 14/407,379

(22) PCT Filed: Jun. 11, 2012

(86) PCT No.: PCT/EP2012/061019

§ 371 (c)(1),
(2), (4) Date: Jan. 30, 2015

(87) PCT Pub. No.: WO2013/185801

PCT Pub. Date: Dec. 19, 2013

(65) Prior Publication Data

US 2015/0167681 A1 Jun. 18, 2015

(51) Int. Cl.

| | |
|---|---|
| ***B08B 9/00*** | (2006.01) |
| ***F04D 25/06*** | (2006.01) |
| ***F04D 29/70*** | (2006.01) |
| ***F04D 31/00*** | (2006.01) |
| ***B08B 3/04*** | (2006.01) |
| ***B08B 5/02*** | (2006.01) |

(52) U.S. Cl.

CPC ..... *F04D 25/0686* (2013.01); *B08B 3/04* (2013.01); *B08B 5/02* (2013.01); *F04D 29/705* (2013.01); *F04D 31/00* (2013.01)

(58) Field of Classification Search

None

See application file for complete search history.

(56) References Cited

U.S. PATENT DOCUMENTS

| | | | |
|---|---|---|---|
| 2009/0050326 | A1 | 2/2009 | Grynning |
| 2010/0135769 | A1 | 6/2010 | Kleynhans et al. |
| 2011/0197923 | A1 | 8/2011 | Battaglioli et al. |

FOREIGN PATENT DOCUMENTS

| | | | | |
|---|---|---|---|---|
| EP | 0298442 | A2 | 1/1989 | |
| EP | 2286933 | A1 | 2/2011 | |
| NO | WO 2007004886 | A1 * | 1/2007 | ..... B08B 9/00 |
| RU | 2433315 | C2 | 11/2011 | |

(Continued)

OTHER PUBLICATIONS

Jan. 22, 2016 Office Action—App 2015100256/06(000496) Eng Tran.

(Continued)

*Primary Examiner* — Eric Golightly

(74) *Attorney, Agent, or Firm* — Banner & Witcoff, Ltd.

(57) ABSTRACT

There are described methods and apparatus for operating and/or cleaning a compressor. In an embodiment, a first fluid comprising gas may be passed through the compressor, while the compressor operates to compress the first fluid. A second fluid may be passed through the compressor, the second fluid comprising gas and liquid from at least one well. The second fluid may be passed through the compressor for a limited time period to clean a surface inside the compressor, while the compressor operates to compress the second fluid.

20 Claims, 4 Drawing Sheets

(56) References Cited

FOREIGN PATENT DOCUMENTS

| | | | |
|---|---|---|---|
| SU | 1211471 | A1 | 2/1986 |
| WO | 2007/004886 | A1 | 1/2007 |
| WO | 2007004886 | A1 | 1/2007 |

OTHER PUBLICATIONS

Jan. 22, 2016—Search Report—App 2015100256/06(000496).
International Search Report and Written Opinion mailed Jan. 2, 2013 (PCT/EP2012/061019); ISA/EP.

* cited by examiner

SUBSEA COMPRESSOR CLEANING METHOD WHEREIN THE CLEANING LIQUID IS RETRIEVED FROM THE MULTIPHASE PROCESS FLUID

The application is a U.S. National Phase Entry of International Application PCT/EP2012/061019 filed on Jun. 11, 2012. The present application claims priority to and the benefit of the above-identified application and is incorporated by reference herein in its entirety.

TECHNICAL FIELD

The present invention relates to the field of compressor cleaning.

BACKGROUND

Gas compression can be a useful step in the processing of a gas where an increase in pressure is needed. In the oil and gas industry, hydrocarbon fluids from wells need to be processed into a marketable product, and it can be useful to use gas compressors as a part of the processing of well fluids to compress the gas to help transport the well fluid from one location to the next. Indeed, it can be necessary to use gas compressors to achieve a sufficiently high rate of production from the well.

Such compressors may be commissioned to provide a certain, required output in terms of pressure of the compressed gas. The degree of compression provided by the compressor may be ramped up over time to compensate for a reduction in upstream pressure.

In multiphase fluid processing, it can be useful or necessary to remove as much liquid as possible from the gas before the gas is passed through the compressor and compressed. Additional processing components located upstream of the compressor may be used to try to reduce or minimise any liquid content in the gas before the gas reaches the compressor. For example, a multiphase flow may be separated into gas and liquid in a separator.

Preparation of the gas upstream of the compressor may be imperfect, such that the gas that enters the compressor may contain some liquid or moisture in very small quantities. High temperatures inside the compressor may cause the liquid entrained in the gas to vaporize away. However, this can cause solids materials such as scale to deposit on surfaces inside the compressor. Such deposits can detrimentally affect compressor performance and reduce the life time of the compressor.

There is therefore a need for compressors to be cleaned to remove deposits. Existing cleaning solutions for compressors include online cleaning by adding a solvent to the gas that is being processed. The solvent additive passes through the compressor with the gas to clean the interior surfaces. Permanent nozzles and piping systems attached to the compressor may be provided for doing this. The use of solvent may be costly and may have environmental drawbacks. For compressors in a subsea environment where there is a greater demand on robustness of equipment, cleaning systems of this nature may not even be a feasible option.

SUMMARY OF THE INVENTION

The present inventors have realised that the presence of liquid in the gas being processed, being a cause of the problem of the deposition of materials such as scale inside gas compressors, can be used to alleviate that same problem.

In particular, it is found that the liquid actually produces a cleaning effect under the right conditions.

According to a first aspect of the invention, there is provided a method of operating and cleaning a compressor, the method comprising:

a. passing a first fluid through the compressor, said first fluid comprising gas, said compressor operating to compress the first fluid passed therethrough; and b. passing a second fluid through the compressor, said second fluid comprising gas and liquid, said gas and liquid being from at least one well, wherein said second fluid is passed through the compressor for a limited time period to clean a surface inside the compressor, said compressor operating to compress the second fluid passed therethrough.

According to a second aspect of the invention, there is provided apparatus for cleaning a compressor, the apparatus comprising:

supply means for passing first and second fluids through the compressor for compressing the first or second fluids, said second fluid comprising gas and liquid from at least one well; and control means arranged to supply the second fluid into the compressor via the supply means for a limited period of time to clean an inside surface of the compressor.

The control means may be further arranged to modify the first fluid to form the second fluid. The control means may include composition control means to control the composition of the first and/or second fluids, for example the amount of liquid and gas contained in the first and second fluids.

According to a third aspect of the invention, there is provided a method of cleaning a compressor, the method comprising:

passing a fluid through the compressor, said fluid containing gas and liquid;

compressing the fluid to a first level of compression using the compressor; and subsequently reducing the level of compression of the fluid by the compressor to a second level of compression, being lower than said first level of compression, wherein said second level of compression is chosen such that the fluid passed through the compressor cleans a surface inside the compressor.

Further features may be defined in relation to each and any of the above aspects, as set out in the claims appended hereto or in the present description.

It will be appreciated that features mentioned in relation to any of the above aspects, whether in the claims or in the description, may be combined between the different aspects in any appropriate combination.

DRAWINGS AND DESCRIPTION OF THE INVENTION

There will now be described, by way of example only, embodiments of the invention with reference to the accompanying drawings in which.

Figure 1:
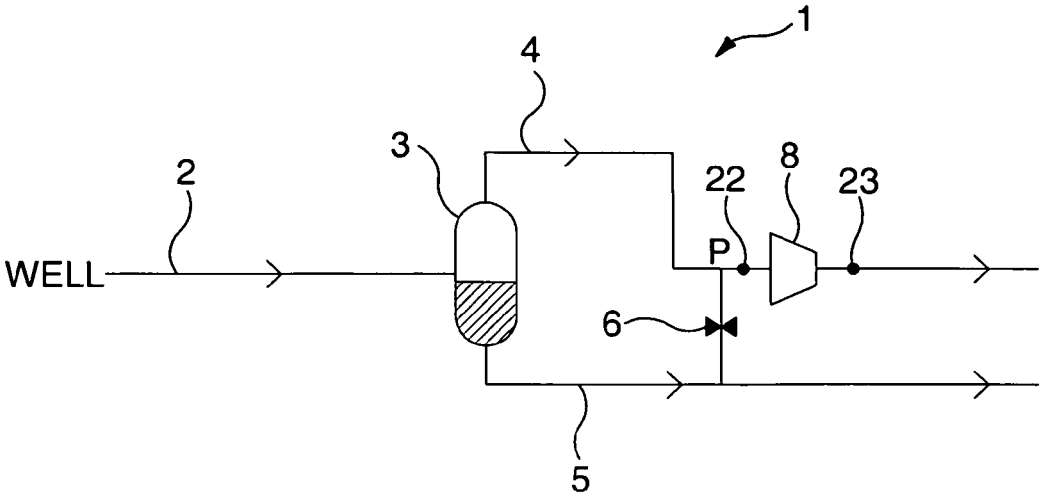
FIG. 1 is a representation of a well fluid processing system according to an embodiment of the invention.

With reference to FIG. 1, there is shown a fluid processing system for processing fluids from a well. In hydrocarbon wells, such fluids may include oil, gas, water, and gas condensate.

The system includes a gas compressor 8 through which gas from the well is passed. The compressor 8 operates to compress the gas, to facilitate transport of the gas onward for further processing downstream of the compressor. The compressor has an inlet for intake of the gas to be compressed, and an outlet fluidly connected to the inlet to output compressed gas (not shown). The compressor may have a compressor body (not shown) extending between the inlet and outlet and defining a flow channel for conveying gas therebetween. In use, the gas stream is passed into the inlet, through the compressor body and out of the outlet.

In this example, the system has a separator 3 located upstream of the compressor. The separator 3 receives well fluid via well fluid stream 2 comprising liquid and gas. The separator 3 acts to separate gas and liquid from the well stream 2 into a gas stream 4 and a liquid stream 5. The system additionally uses a combining means to recombine separated liquid and gas from the separator, for controlling the amount of liquid in the gas stream 4. To this end, the combining means has a controllable valve 6 which may be opened, when required, to fluidly connect the liquid stream 5 with the gas stream 4, so that liquid from the liquid stream 5 can be inserted into the gas of gas stream 4 so that the gas contains liquid.

During normal operation, the valve 6 is closed, so that the separated liquid and gas streams 4, 5 are not remixed with each other before the gas enters the compressor 8. The gas stream 4, is received by the compressor 8, and the compressor compresses the gas (constituting a "first fluid"). Liquid in the liquid stream 5 continues to flow past the compressor, separately of the gas stream 4. The gas and liquid streams 4, 5 may or may not be combined with each other further downstream of the compressor.

At the point of mixing P, the gas stream 4 may be provided with an ejector to accelerate the flow of gas. This may facilitate mixing of the gas with liquid from stream 5 to help control the composition of the fluid entering the compressor 8.

Typically, the condition of the gas stream upstream and downstream of the compressor 8 and/or the performance of the compressor are monitored. The condition of the gas (e.g. a wet, liquid-containing gas) may be the temperature, pressure and/or composition of the gas stream. The performance of the compressor may be the increase in pressure or temperature between the inlet and outlet of the compressor. In this example, the monitoring of conditions or performance can be carried out by applying measurement apparatus 22, 23 upstream and downstream of the compressor. The measurement apparatus 22 and 23 each comprises a multiphase flow meter, and temperature and pressure sensors. The amount of liquid in the gas can determined from flow meter measurements. A change in condition of the gas and/or performance of the compressor may indicate that a deposit has formed on a surface inside the compressor 8. For example, this change may be a drop in pressure of compressed gas downstream of the compressor. The measured conditions or performance may be compared with previous or expected (modelled) performance.

If the presence of a deposit on a surface inside the compressor is detected from measured data, the valve 6 is opened. It will be appreciated that this may occur when the liquid in the gas stream is very low, e.g. when liquid is measured in the gas upstream but not downstream of the compressor. Liquid from the liquid stream 5 is then inserted into the gas of gas stream 4, such that the gas stream passed into the compressor comprises gas with an amount of liquid entrained therein (constituting a "second fluid"). As the gas stream 4 passes through the compressor, the gas with liquid contained therein acts to remove the detected deposit. Thus, the gas with liquid acts to clean or wash the internal surfaces of the compressor across which the gas is passed. Such surfaces may be surfaces that define the flow channel of the compressor body that come into contact with the gas. In a rotating compressor, these surfaces may include those of a rotating blade. Once the deposit has been removed, the valve 6 may be closed to reduce the liquid content in the gas stream, and the compressor can continue to perform at previous or improved performance level, e.g. with no or with the original very low amount of liquid contained in the gas (constituting a "third fluid"). With the deposit removed, the compressor may perform close to an ideal level of performance or of compression. The removal of the deposit may be detectable as an increase in performance, or change in the conditions of the gas upstream or downstream of the compressor back to previous values. Similar cycles of cleaning may be performed as and when further deposits build up and are detected, or suspected.

In order to provide cleaning upon detecting the deposit, the amount of liquid in the gas (second fluid) is made sufficiently great that complete vaporization of the liquid does not occur upon passing the gas through the compressor. In other words, the gas needs to remain as a two-phase gas, i.e. a gas with liquid entrained therein, as it enters and exits the compressor. If there is insufficient liquid in the gas stream as it enters the compressor, the liquid may vaporise away and deposits may form inside the compressor.

Thus, upon inserting liquid into the gas stream via valve 6, the system is moved from a condition in which scaling occurs to one in which cleaning occurs. Typically, in order to provide cleaning, the system is arranged such that the liquid carry over into the gas upstream of the compressor, for example by appropriate operation of processing components such as valve 6 or separator 3, is up to around 20 times greater than the liquid content in conditions where deposits form. Typically, this may be 2 to 20 times greater, but higher amounts may also be feasible. Gas having a liquid content in an amount of up to around 5% by weight, may result in deposits forming inside the compressor. For example, a content of liquid of 0.2% to 0.6% by weight may result in a deposit, typically. In general, it will be appreciated that the amount of liquid required in order to remove deposits from surfaces inside the compressor is dependent on how much liquid evaporates from the gas as it passes through the compressor. This is in turn dependent upon the pressure and temperature conditions of the gas.

Computer modelling packages are commercially available to allow processing systems such as that shown in FIG. 1 to be modelled. Such packages can be used to determine the amount of liquid required in the gas supplied to the compressor at the inlet for purposes of cleaning. Flow measurements downstream may verify that the amount supplied is sufficient, and that full vaporisation is not occurring. The models may define relationships between parameters for different parts of the system, including relationships between temperature, pressure and liquid content for a given configuration of processing components and fluids.

Figure 3A:
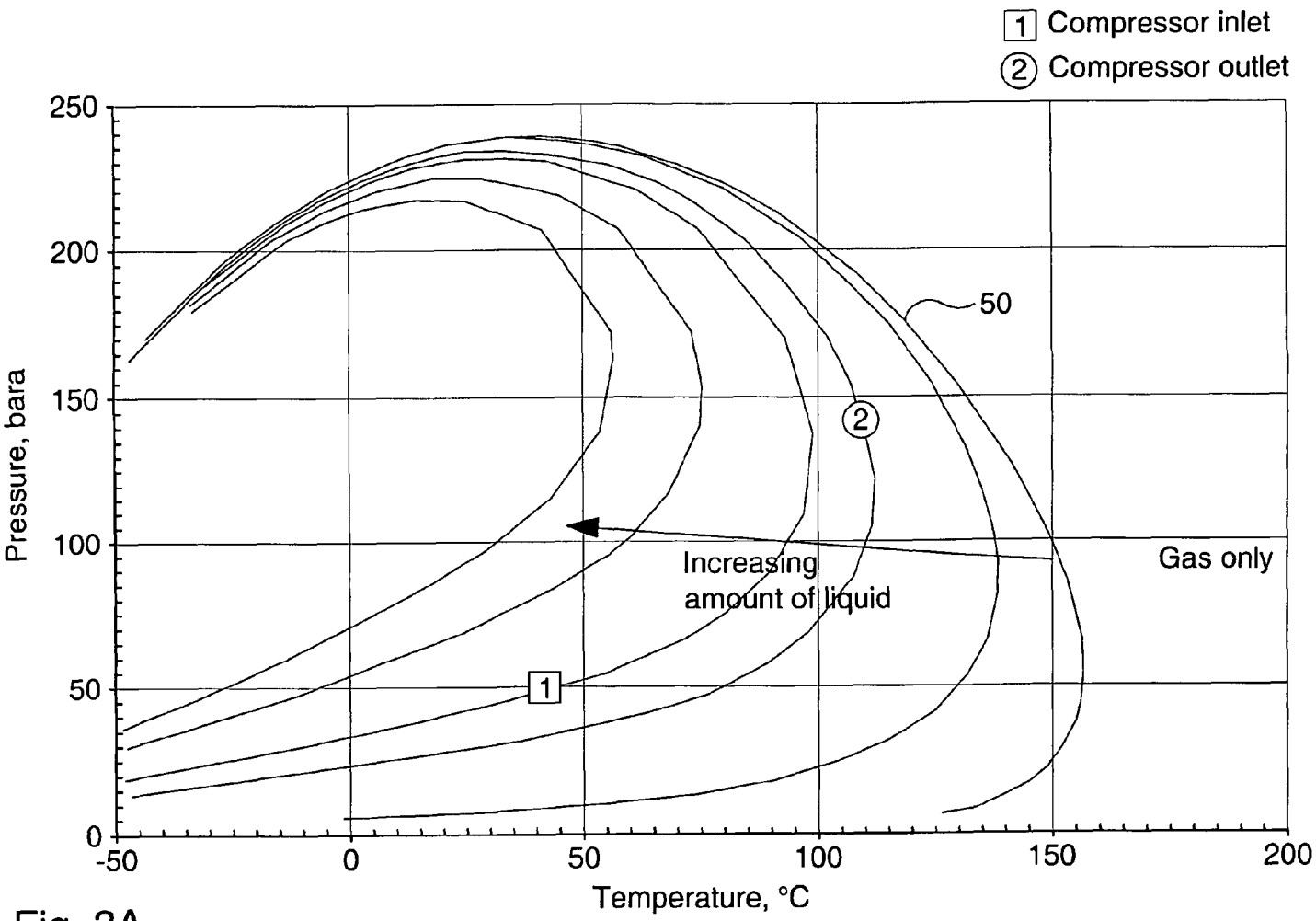
FIGS. 3A and 3B are "phase envelope" plots, describing the amount of hydrocarbon gas and liquid as a function of pressure and temperature for the selected well stream compositions.
Figure 3B:
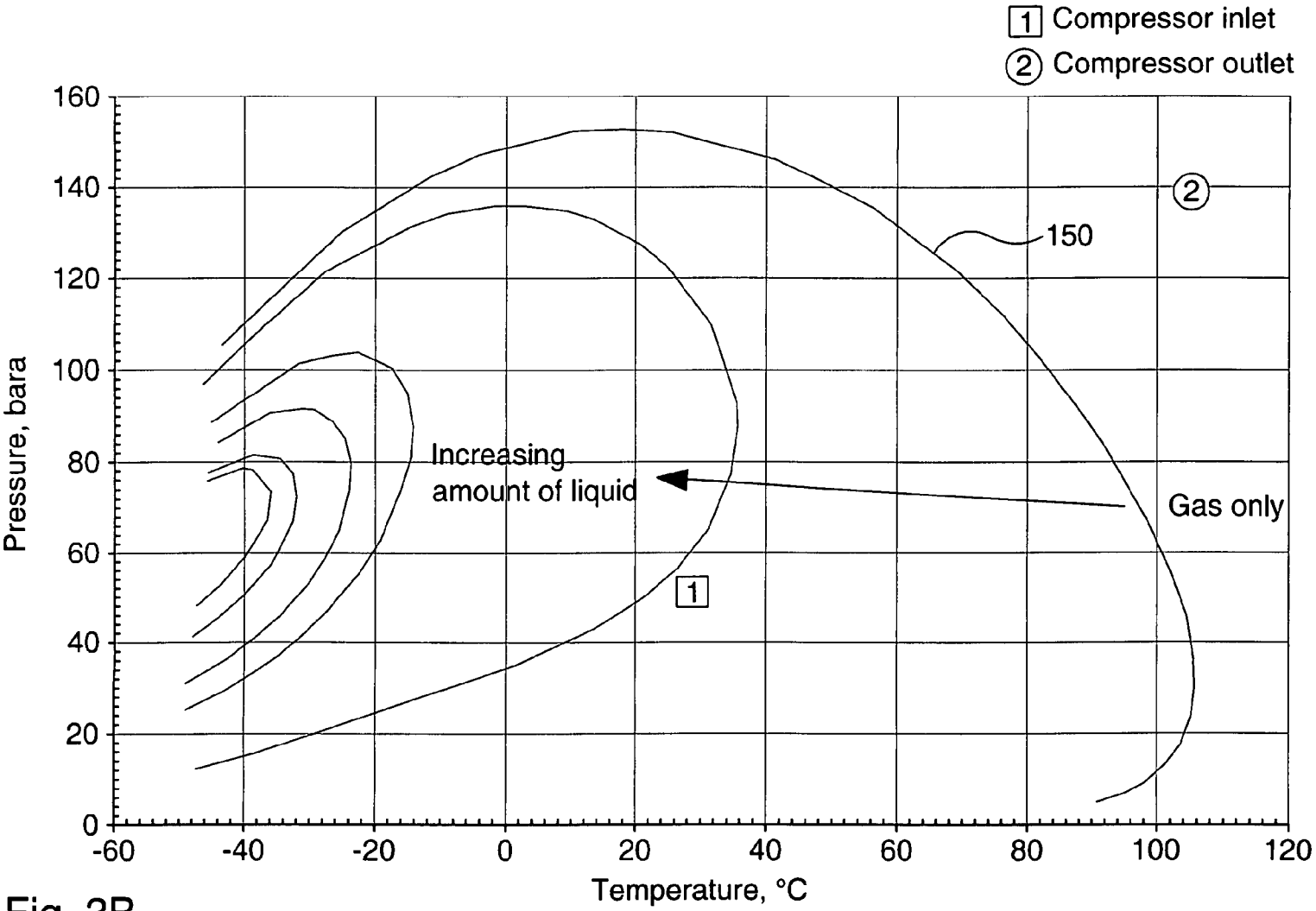

FIGS. 3A and 3B provide phase envelope plots for different well streams showing the hydrocarbon gas and liquid amounts as a function of pressure and temperature. Compressor inlet and outlet operating points are indicated.

In FIG. 3A, it may be seen that typical compression of the gas with a medium quantity of liquid from about 50 to 150 bar and a temperature increase from around 40 to around 110 degrees Celsius would reduce the liquid content due to vaporisation. However, it can also be seen that the compressed gas (point 2) remains inside the liquid content boundary 50. Conversely, in FIG. 3B, for a different system the phase envelope plot indicates that for a similar compressor for similar compression and temperature increase produces compressed gas with an output point (point 2) outside the liquid content boundary 150 upon compression, indicating that the liquid in the gas at the inlet evaporates fully as it passes through the compressor, and is operating under conditions in which formation of a deposit can be expected.

In practice, the amount of liquid in the gas on the inlet (upstream) and outlet (downstream) sides of the compressor 8 may be determined using flow meters, as is known in the art. Temperature and pressure conditions may also be monitored upstream and downstream.

A changed performance in the compressor, e.g. reduction in the degree of compression produced, can be indication of scale formation, particularly where the measured content of liquid in the gas upstream of the inlet to the compressor is low and indicates that complete evaporation of the liquid would occur. In certain embodiments, the detection of a reduction in the performance below a predetermined level and/or for a predetermined amount of time may signify a detection of a deposit, upon which cleaning may be initiated by opening of the valve 6 to insert liquid into the gas.

When cleaning is performed, the amount of liquid inserted into the gas may be controlled by use of the valve as indicated above, to maintain sufficiently high levels of liquid in the gas, for the period of cleaning.

In other embodiments, the gas stream 4 may be provided with a cooler for cooling the gas. When a need for cleaning of the surface inside the compressor is determined, the cooler may be operated to cool the gas and condensate liquid, to generate the necessary liquid in the gas.

Accordingly, different processing components upstream of the compressor can be used to control the liquid content of the gas. In other embodiments still, the separation performance of the separator 3 may control the amount of liquid, either passively by virtue of its performance characteristics or actively by controlling operational parameters. Other processing components may also be operated, in a similar manner, to control the amount of liquid contained in the gas. It will be appreciated that available components for well processing systems have known performance characteristics, and that computer packages are available for designing the system and modelling performance for different input components or make-up. Typical processing components which may be used include coolers/heaters, separators, scrubbers, expanders, pumps and valves and the like.

Figure 2:
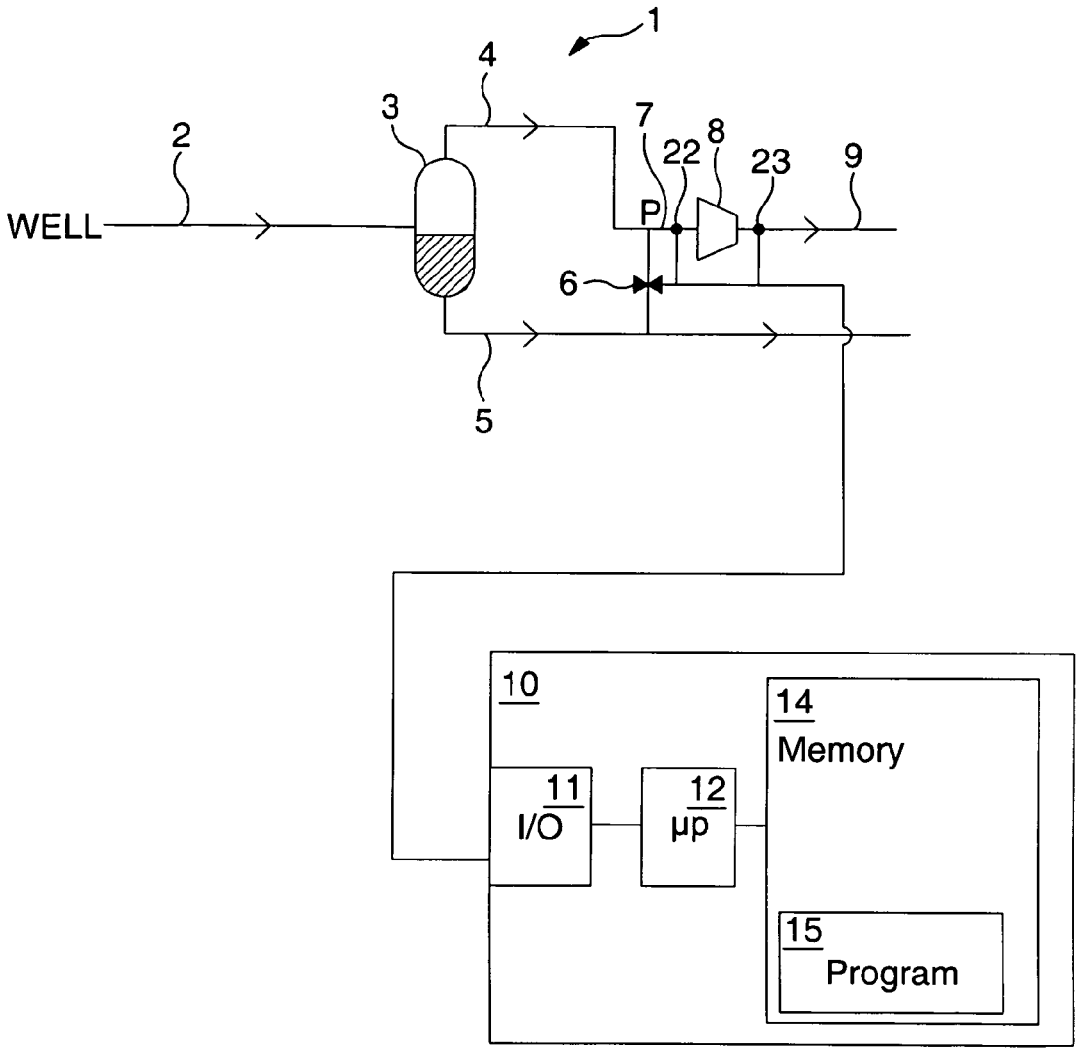
FIG. 2 is a representation of the system of FIG. 1, coupled to a control system.

With reference to FIG. 2, the processing system 1 is shown coupled to a control system. The controllable valve 6 is connected to a computer device 10 of the control system for controlling insertion of a well stream liquid component through controllable valve 6 into the gas. In this example, the controllable valve 6 is operatively coupled to a computer device 10 using an In/Out device 11. Similarly, the flow meters of measurement apparatus 22, 23 are connected to the computer device 10 via the In/Out device through which measurement data from the flow meters are received. Flow meter data can be used to estimate the amount of liquid in the gas. The pressure and temperature sensors of measurement apparatus 22, 23 are also connected via the In/Out device to the computer device, to provide temperature and pressure measurement data. Such data are used for monitoring the conditions of the gas, and performance of the compressor, to determine whether a deposit has formed or been removed from inside the compressor.

The In/Out device 11 is used for sending instructions to the controllable valve 6 to operate the valve accordingly, and for receiving data therefrom, for example to provide valve status or liquid flow rate information or the like. A processor 12 is used for generating instructions to be sent to the controllable valve 6 to control a flow of a well stream liquid component into the separated gas. A computer readable medium in the form of a memory 14 is also provided. The memory 14 can be used for storing collected data, preprogrammed instructions for the controllable valve 6 or other processing components. The memory 14 may also be used to store a program 15 that includes instructions to be executed by the processor. The program may contain instructions for opening the valve to add liquid when needed to ensure that the liquid content is suitable for producing cleaning of the compressor. The control system may receive measurement data from measurement sensors used on other processing components for measuring a process parameter at different locations of the processing system, for example the temperature or pressure of a separator. The program may include instructions to operate the valve or other processing component in dependence upon such measurements.

In order to produce cleaning of the compressor 8, the computer device 10 may send instructions to the controllable valve 6 to open the valve to a greater or lesser extent, permitting a flow of separated liquid from the liquid stream 5 through the valve 6 and to mix with the separated gas of gas stream 6. The flow of liquid through the valve may be increased gradually and steadily over a period of time to minimise any effects upon the operation of the compressor. The compressor may run continuously whilst liquid is inserted into the gas to remove the deposit, compressing the gas with liquid therein as it is passed therethrough.

Figure 4:
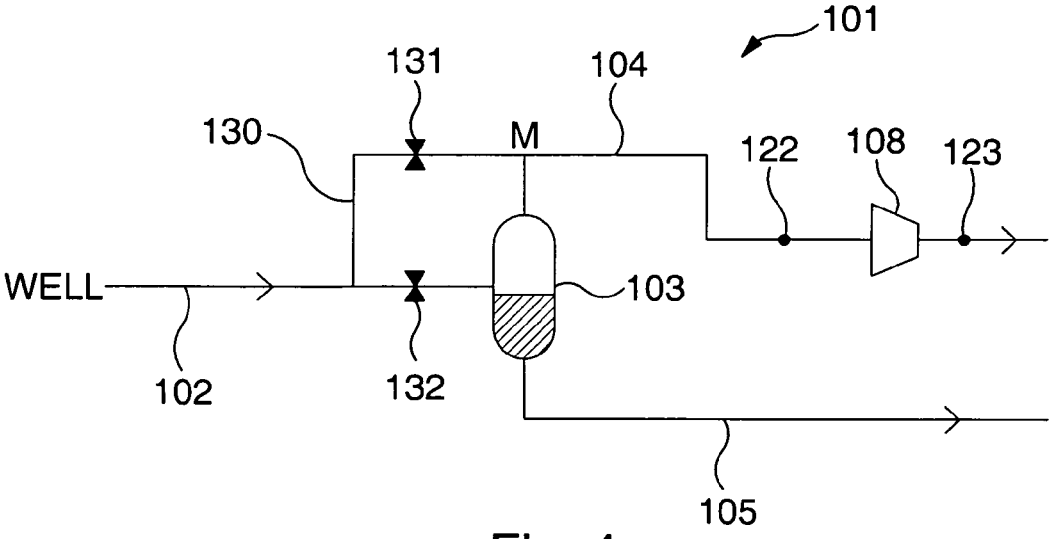
FIG. 4 is a representation of a well fluid processing system according to another embodiment of the invention.

With reference to FIG. 4, another example processing system 101 is shown for modifying the well fluid entering the compressor for cleaning the compressor. The system of FIG. 4 has similar components to that of FIG. 1, with corresponding components denoted using the same numerals but incremented by one hundred.

In FIG. 4, the well fluid 102 may bypass the separator 103 through a branch 130, such that the fluid from well stream 102 can be mixed or combined with the gas stream 104 at point M to produce combined fluid 134 downstream of the scrubber for passing into the compressor. In circumstances where the fluid of well stream 102 contains significant amounts of liquid, combining the well stream fluid 102 with the gas stream 104 from the separator may produce a combined fluid 134 comprising gas with sufficient liquid therein to clean the compressor. Controllable valves 131 and 132 are operable similarly to valve 6 from a control system as described for the embodiments above. These valves 131, 132 are adjustable to direct and split the well stream 102 selectively between the separator 103 and the bypass branch 130.

In a further embodiment, and as will be appreciated from the phase envelope diagram shown in FIG. 3B, it will in certain situations be possible to clean the compressor using the fluid being supplied to the compressor by deliberately reducing the amount of compression provided by the compressor, i.e. the pressure increase generated. This may be operationally acceptable for a limited period of time. Considering for example FIG. 3B, typical operating conditions, e.g. normal operating conditions of the compressor, are shown where the temperature and pressure condition of the compressed gas is as indicated by point 2 outside of the boundary 150, resulting in the build up of a deposit inside the compressor. This may be an ideal or close to ideal operating condition. However, reducing the amount of compression temporarily can reduce the temperature build up inside the compressor, bringing the end point 2 to a lower temperature and pressure that is within the phase envelope boundary 150. The liquid in the fluid may then not vaporise completely as it passes through the compressor, and cleaning of the compressor can be established to remove the deposit. After reducing the level of compression and the deposit is removed, the level of compression may be increased to its original level and normal operating conditions.

It can be noted that for some embodiments both the level of compression provided by the compressor may be changed as mentioned above in relation to FIG. 3B and the composition of the gas may be modified upstream of the compressor as mentioned above in relation to for example FIG. 1, in order to achieve a composition for the fluid entering the compressor with a suitable liquid content for removing a deposit on a surface inside the compressor.

It will be appreciated that suitable pipework would in practice be provided for receiving and combining the various streams of well fluids as indicated in the examples described above. Further pipework, valves and the like may also be incorporated in practice, for example to provide bypasses for fluid around one or more components of the system, compressor surge protection, or to build in additional functionality for example to satisfy safety standards.

It can also be noted that the cleaning of the compressor may be performed on a compressor used top sides, on land or subsea.

The present cleaning technique provides advantages in that dedicated cleaning additives are not needed for cleaning; the use of liquid being processed is enough simply by controlling the liquid content. This is convenient and cost effective, and avoids problems associated with additives. In addition, the compressor can operate with no or minimal moisture content in periods where cleaning is not required, to help maximise compressor performance. Cleaning the compressor within a limited period of time can be useful to minimise remixing of separated gas and liquid.

Various modifications and improvements may be made within the scope of the invention herein described.

The invention claimed is:

1. A method of operating and cleaning a compressor, the method comprising:

a. passing a first fluid through the compressor, said first fluid comprising gas, and said compressor operating to compress the first fluid passed therethrough;

b. modifying the first fluid to produce a second fluid comprising gas and liquid, said gas and liquid being from at least one well, wherein said modification comprises cooling said gas of the first fluid upstream of the compressor to condensate liquid, the liquid contained in the second fluid including said condensate liquid, or wherein said modification comprises changing the level of compression of the fluid by the compressor; and c. passing the second fluid through the compressor, wherein said second fluid is passed through the compressor for a limited time period to clean a surface inside the compressor, said compressor operating to compress the second fluid passed therethrough.

2. The method as claimed in claim 1, which further includes, subsequent to step b, the following step:

d. when said limited time period is over, passing a third fluid through the compressor wherein said third fluid contains either less liquid than said second fluid or no liquid.

3. The method as claimed in claim 1 which further includes:

determining the presence or potential presence of a deposit of material on said surface of the compressor; and performing at least one of said step c and step d upon said determination, wherein said step d comprises: when said limited time period is over, passing a third fluid through the compressor, wherein said third fluid contains either less liquid than said second fluid or no liquid.

4. The method as claimed in claim 1, wherein said step c is performed to least partly remove a deposit of material on said surface of the compressor, in order to clean said surface of the compressor.

5. The method as claimed in claim 1, wherein the first fluid has a composition which, upon passage of the first fluid through the compressor, causes formation of a deposit on said surface inside the compressor.

6. The method as claimed in claim 1, wherein the first fluid has a liquid content of 0 to 5% by weight.

7. The method as claimed in claim 1, wherein the liquid contained in the second fluid is present in a greater amount than any liquid contained in the first fluid.

8. The method as claimed in claim 1, wherein the amount of liquid contained in the second fluid is sufficiently great that complete vaporization of the liquid does not occur by passage of the second fluid through the compressor.

9. The method as claimed in claim 1, which further includes:

identifying a changed performance of the compressor, said changed performance suggestive of a need for cleaning; and performing at least one of said step c and/or step d after said identification, wherein said step d comprises: when said limited time period is over, passing a third fluid through the compressor, wherein said third fluid contains either less liquid than said second fluid or no liquid.

10. The method as claimed in claim 1, which further includes:

measuring a property of the first fluid; and performing step c and/or step d after said measurement or based upon said measured property, wherein said step d comprises: when said limited time period is over, passing a third fluid through the compressor, wherein said third fluid contains either less liquid than said second fluid or no liquid.

11. The method as claimed in claim 10, which further includes using the measured property of the first fluid to identify a presence or possible presence of a deposit, and wherein said performance of step c and/or step d is based on said identification.

12. The method as claimed in claim 1, which further includes:

measuring a property of a compressed fluid produced by compression of the first fluid upon passage through the compressor;

using the property of the compressed fluid to determine a need for cleaning; and performing at least one of said step c and step d based on the determined need for cleaning, wherein said step d comprises: when said limited time period is over, passing a third fluid through the compressor, wherein said third fluid contains either less liquid than said second fluid or no liquid.

13. The method as claimed in claim 1, which further includes:

measuring a property of a fluid to be compressed by the compressor or a fluid produced by compression by the compressor, or measuring a performance of the compressor;

comparing the measured property of said fluid or performance of the compressor with a reference value;

determining a need for cleaning based on said comparison; and performing at least one of step c and/or step d upon determination the need for cleaning, wherein said step d comprises: when said limited time period is over, passing a third fluid through the compressor, wherein said third fluid contains either less liquid than said second fluid or no liquid.

14. The method as claimed in claim 1, wherein said at least one well is a hydrocarbon well.

15. The method as claimed in any claim 1, wherein the gas contained in the second gas comprises hydrocarbon gas, and the liquid contained in the second gas comprises at least one of hydrocarbon liquid, gas condensate and water.

16. A method of cleaning a compressor, the method comprising:

passing a fluid through the compressor, said fluid containing gas and liquid;

compressing the fluid to a first level of compression using the compressor; and subsequently reducing the level of compression of the fluid by the compressor to a second level of compression, being lower than said first level of compression, wherein said second level of compression is chosen such that the fluid passed through the compressor cleans a surface inside the compressor.

17. The method as claimed in claim 16, wherein said cleaning of the surface comprises removing a deposit from said surface of the compressor.

18. The method as claimed in claim 16 which includes a subsequent step of increasing the level of compression of fluid by the compressor to a third level of compression, being higher than said second level of compression.

19. The method as claimed in claim 18, wherein said third level of compression is higher than said first level of compression.

20. The method as claimed in claim 18, wherein at said first or third levels of compression, the fluid contains no liquid or insufficient liquid for cleaning said surface of the compressor.

* * * * *